US011047203B2

(12) United States Patent
Fripp et al.

(10) Patent No.: US 11,047,203 B2
(45) Date of Patent: Jun. 29, 2021

(54) SWELLABLE METAL PACKER WITH POROUS EXTERNAL SLEEVE

(71) Applicant: HALLIBURTON ENERGY SERVICES, INC., Houston, TX (US)

(72) Inventors: Michael Linley Fripp, Carrolton, TX (US); Stephen Michael Greci, Little Elm, TX (US); Abdel Hamid R. Abeidoh, Dallas, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/768,448

(22) PCT Filed: Sep. 24, 2018

(86) PCT No.: PCT/US2018/052447

§ 371 (c)(1),
(2) Date: May 29, 2020

(87) PCT Pub. No.: WO2020/068037

PCT Pub. Date: Apr. 2, 2020

(65) Prior Publication Data

US 2020/0370391 A1 Nov. 26, 2020

(51) Int. Cl.

| | |
|---|---|
| ***E21B 33/12*** | (2006.01) |
| ***E21B 33/127*** | (2006.01) |
| ***E21B 23/06*** | (2006.01) |
| ***E21B 23/00*** | (2006.01) |

(52) U.S. Cl.

CPC ..... *E21B 33/1212* (2013.01); *E21B 33/1277* (2013.01); *E21B 23/00* (2013.01); *E21B 23/06* (2013.01); *E21B 33/12* (2013.01); *E21B 33/127* (2013.01); *E21B 33/1208* (2013.01)

(58) Field of Classification Search

CPC ..... E21B 33/1212; E21B 33/1277; E21B 33/1208; E21B 33/12; E21B 33/127; E21B 33/122; E21B 23/06; E21B 23/00

See application file for complete search history.

(56) References Cited

U.S. PATENT DOCUMENTS

| | | | |
|---|---|---|---|
| 7,472,757 B2 | 1/2009 | Freyer | |
| 9,404,030 B2 | 8/2016 | Mazyar et al. | |
| 2010/0314134 A1 | 12/2010 | Nutley et al. | |
| 2017/0342797 A1 | 11/2017 | Murphree et al. | |
| 2018/0094509 A1* | 4/2018 | Braddick | E21B 43/106 |

FOREIGN PATENT DOCUMENTS

WO WO2016/137439 A1 9/2016

OTHER PUBLICATIONS

International Search Report and Written Opinion from PCT/US2018/052447, dated Jun. 19, 2019, 12 pages.

* cited by examiner

*Primary Examiner* — Tara Schimpf
*Assistant Examiner* — Manuel C Portocarrero
(74) *Attorney, Agent, or Firm* — Haynes and Boone, LLP

(57) ABSTRACT

A method for forming a seal in a wellbore that includes positioning a swell packer that comprises a swellable metal sealing element in the wellbore; wherein a porous layer is disposed about the swellable metal sealing element. The method also includes exposing the swellable metal sealing element to a downhole fluid; allowing or causing to allow the swellable metal sealing element to produce particles; and accumulating the particles within a first annulus formed between the porous layer and the tubular.

20 Claims, 9 Drawing Sheets

FIG.5

SWELLABLE METAL PACKER WITH POROUS EXTERNAL SLEEVE

CROSS-REFERENCE TO RELATED APPLICATION

The present application is a U.S. National Stage patent application of International Patent Application No. PCT/US2018/052447, filed on Sep. 24, 2018, the benefit of which is claimed and the disclosure of which is incorporated herein by reference in its entirety.

TECHNICAL FIELD

The present disclosure relates to the use of a swellable metal packer, and more particularly, to the use of a swellable metal packer with a porous external sleeve.

BACKGROUND

Swell packers may be used, among other reasons, for forming annular seals in and around conduits in wellbore environments. The swell packers expand over time if contacted with specific swell-inducing fluids. The swell packers comprise swellable materials that may swell to form an annular seal in the annulus around the conduit. Swell packers may be used to form these annular seals in both open and cased wellbores. This seal may restrict all or a portion of fluid and/or pressure communication at the seal interface. Forming seals may be an important part of wellbore operations at all stages of drilling, completion, and production.

Swell packers are typically used for zonal isolation whereby a zone or zones of a subterranean formation may be isolated from other zones of the subterranean formation and/or other subterranean formations. One specific use of swell packers is to isolate any of a variety of inflow control devices, screens, or other such downhole tools, that are typically used in flowing wells.

Many species of swellable materials used for sealing comprise elastomers. Elastomers, such as rubber, may degrade in high-salinity and/or high-temperature environments. Further, elastomers may lose resiliency over time resulting in failure and/or necessitating repeated replacement. Some sealing materials may also require precision machining to ensure that surface contact at the interface of the sealing element is optimized. As such, materials that do not have a good surface finish, for example, rough or irregular surfaces having gaps, bumps, or any other profile variance, may not be sufficiently sealed by these materials. One specific example of such a material is the wall of the wellbore. The wellbore wall may comprise a variety of profile variances and is generally not a smooth surface upon which a seal may be made easily.

If a swell packer fails, for example, due to degradation of the swellable material from high salinity and/or high temperature environments, wellbore operations may have to be halted, resulting in a loss of productive time and the need for additional expenditure to mitigate damage and correct the failed swell packer. Alternatively, there may be a loss of isolation between zones that may result in reduced recovery efficiency or premature water and/or gas breakthrough.

For swell packers that involve a metal swelling element that produce particles when expanding, high cross flow of downhole fluids across the metal swelling element can wash away the particles to prevent a seal from forming or to prolong the time before a seal is formed.

DETAILED DESCRIPTION

The present disclosure relates to the use of a swellable metal packer, and more particularly, to the use of a swellable metal packer with an external porous sleeve.

Figure 1:
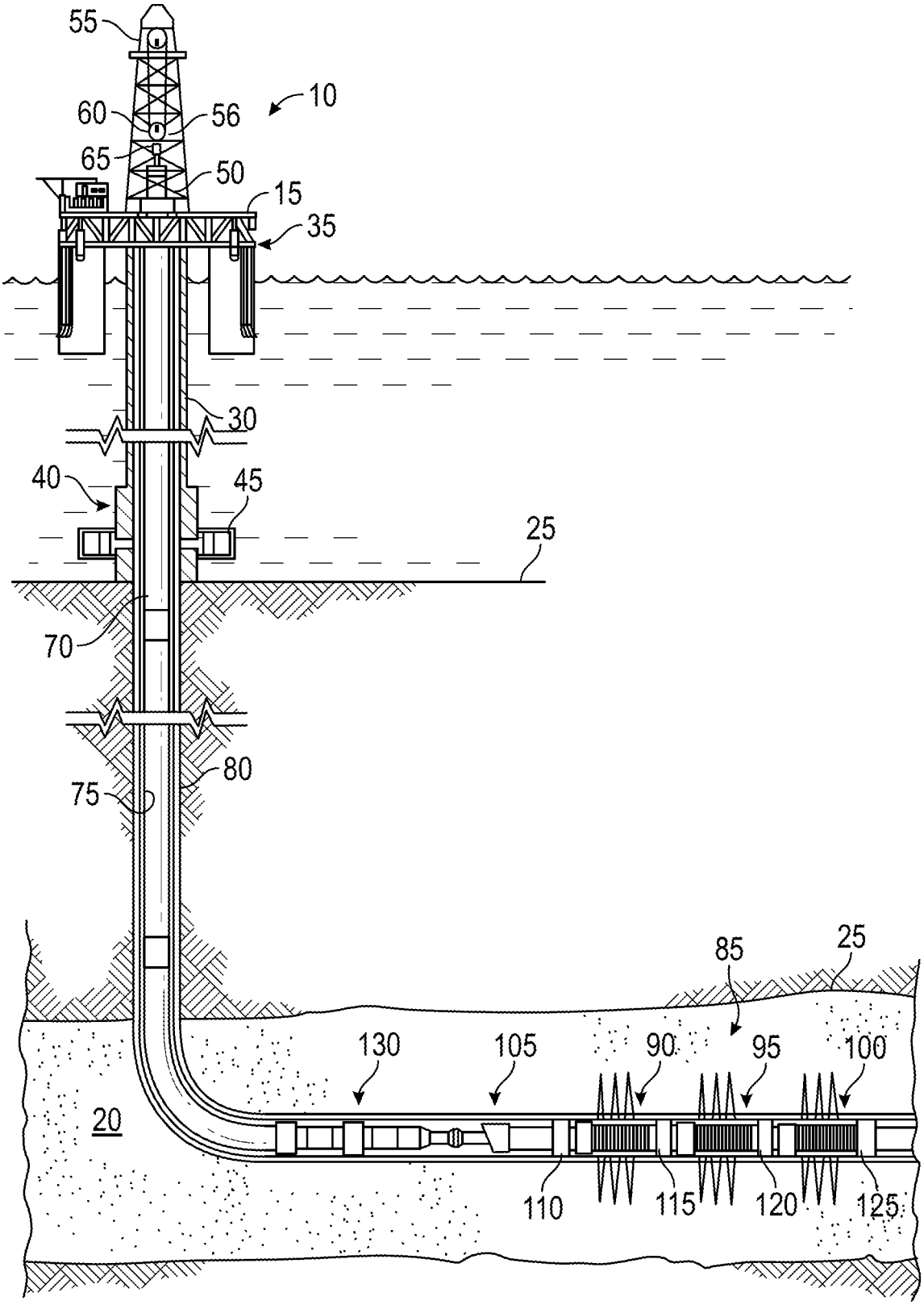
FIG. 1 is a schematic illustration of an offshore oil and gas platform operably coupled to a lower completion assembly according to an embodiment of the present disclosure, the lower completion assembly including a swell packer with an external porous sleeve.

Referring initially to FIG. 1, an upper completion assembly is installed in a well having a lower completion assembly disposed therein from an offshore oil or gas platform that is schematically illustrated and generally designated 10. However, and in some cases, a single trip completion assembly (i.e., not having separate upper and lower completion assemblies) is installed in the well. A semi-submersible platform 15 is positioned over a submerged oil and gas formation 20 located below a sea floor 25. A subsea conduit 30 extends from a deck 35 of the platform 15 to a subsea wellhead installation 40, including blowout preventers 45. The platform 15 has a hoisting apparatus 50, a derrick 55, a travel block 56, a hook 60, and a swivel 65 for raising and lowering pipe strings, such as a substantially tubular, axially extending tubing string 70.

A wellbore 75 extends through the various earth strata including the formation 20 and has a casing string 80 cemented therein. Disposed in a substantially horizontal portion of the wellbore 75 is a lower completion assembly 85 that includes a degradable metal body and that includes at least one screen assembly, such as screen assembly 90 or screen assembly 95 or screen assembly 100, and may include various other components, such as a latch subassembly 105, a swell packer 110, a swell packer 115, a swell packer 120, and a swell packer 125.

Disposed in the wellbore 75 is an upper completion assembly 130 that couples to the latch subassembly 105 to place the upper completion assembly 130 and the tubing string 70 in communication with the lower completion assembly 85. In some embodiments, the latch subassembly 105 is omitted.

Even though FIG. 1 depicts a horizontal wellbore, it should be understood by those skilled in the art that the apparatus according to the present disclosure is equally well suited for use in wellbores having other orientations including vertical wellbores, slanted wellbores, uphill wellbores, multilateral wellbores or the like. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the apparatus according to the present disclosure is equally well suited for use in onshore operations. Further, even though FIG. 1 depicts a cased hole completion, it should be understood by those skilled in the art that the apparatus according to the present disclosure is equally well suited for use in open hole completions.

Examples of the methods and systems described herein relate to the use of non-elastomeric sealing elements comprising swellable metals with an external porous sleeve, or layer, disposed about the swellable metal. As used herein, "sealing elements" refers to any element used to form a seal. The swellable metals may swell in brines and create a seal at the interface of adjacent surfaces (e.g., porous sleeve and wellbore). By "swell," "swelling," or "swellable" it is meant that the swellable metal increases its volume. Advantageously, the non-elastomeric sealing elements may be used on surfaces with profile variances, e.g., roughly finished surfaces, corroded surfaces, 3-D printed parts, etc. An example of a surface that may have a profile variance is a wellbore wall. Yet a further advantage is that the swellable metals may swell in high-salinity and/or high-temperature environments where the use of elastomeric materials, such as rubber, can perform poorly. The swellable metals comprise a wide variety of metals and metal alloys and may swell by the formation of metal hydroxides. The swellable metal sealing elements may be used as replacements for other types of sealing elements (i.e. non-swellable metal sealing elements, elastomeric sealing elements, etc.) in downhole tools, or they may be used as backups for other types of sealing elements in downhole tools. The porous sleeve allows for the downhole fluid to contact the swellable metal while ensuring that the metal hydroxides, or particles created during the swelling, remain positioned in an annulus formed between the wellbore and a tubular or the tubular around which the sealing element is disposed.

Figure 2:
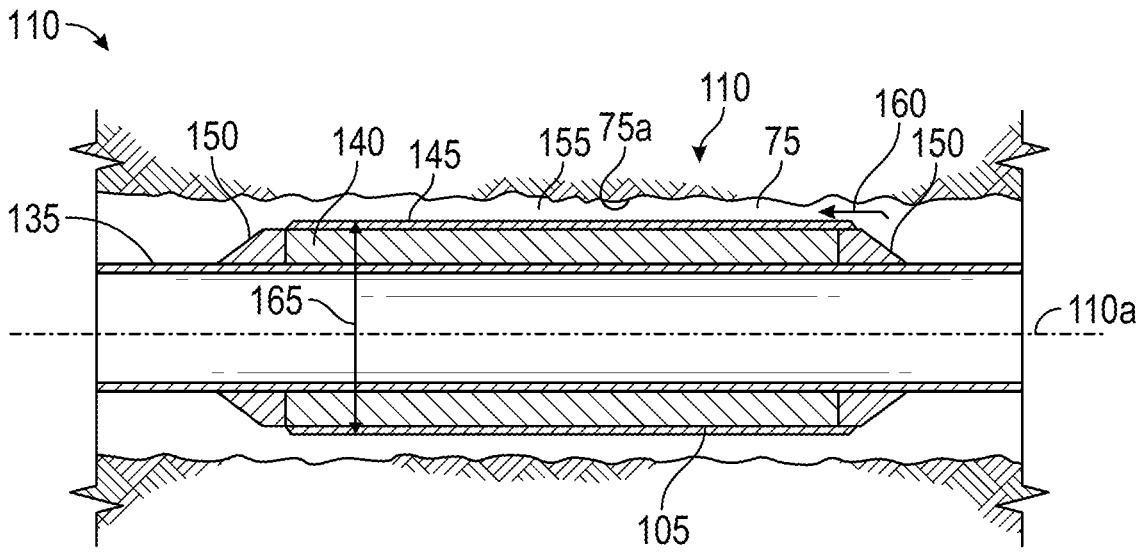
FIG. 2 is a cross-sectional illustration of the swell packer of FIG. 1 in a first configuration, according to an example embodiment.

FIG. 2 is a cross-sectional illustration of an example of the swell packer 110, when in a first configuration, within the wellbore 75 that is an open-hole wellbore. The swell packer 110 is disposed on a tubular or a base pipe 135 and has a longitudinal axis 110*a*. The swell packer 110 comprises a swellable metal sealing element 140 as disclosed and described herein. The swell packer 110 also comprises an external sleeve, or a porous layer 145, that is disposed about the swellable metal sealing element 140. The swell packer 110 is wrapped or slipped on the base pipe 135 with weight, grade, and connection specified by the well design. The base pipe 135 may be any type of conduit used in a wellbore, including drill pipe, stick pipe, tubing, coiled tubing, etc. The swell packer 110 further comprises end rings 150. End rings 150 protect the swellable metal sealing element 140 as it is run to depth. End rings 150 may create an extrusion barrier, preventing the applied pressure from extruding the seal formed from the swellable metal sealing element 140 in the direction of said applied pressure. In some examples, end rings 150 may comprise a swellable metal and may thus serve a dual function as a swellable metal sealing element analogously to swellable metal sealing element 140. In some examples, end rings 150 may not comprise a swellable metal or any swellable material. Although FIG. 2 and some other examples illustrated herein may illustrate end rings 150 as a component of swell packer 110 or other examples of swell packers, it is to be understood that end rings 150 are optional components in all examples described herein, and are not necessary for any swell packer described herein to function as intended. An annulus 155 is defined between a wall 75*a* of the wellbore 75 and the swell packer 110, specifically the base pipe 135 of the swell packer 110. Prior and during swelling of the swellable metal sealing element 140, downhole fluids pass through the annulus 155 in a direction 160 thereby creating a cross flow situation over the swell packer 110.

Figure 3:
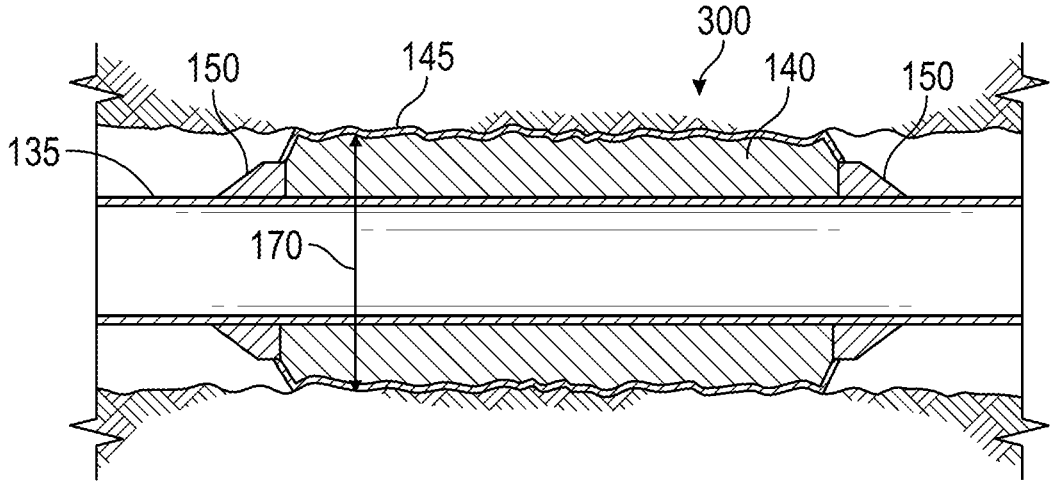
FIG. 3 is a cross-sectional illustration of the swell packer of FIG. 2 in a second configuration, according to an example embodiment.

When exposed to a downhole fluid such as a brine, the swell packer 110 swells and forms an annular seal at the interface of the wall 75*a* when in a second configuration as illustrated in FIG. 3. As such, the porous layer 145 is movable between the first configuration in which the porous layer 145 defines an unexpanded diameter 165 (illustrated in FIG. 2) and the second configuration in which the porous layer 145 defines an expanded diameter 170 that is greater than the unexpanded diameter 165. In alternative examples, the annular seal may be at the interface of the conduit and a casing, downhole tool, or another conduit. This swelling is achieved by the swellable metal increasing in volume. This increase in volume corresponds to an increase in the swell packer 110 diameter and applies an outwardly-extending radial pressure onto the porous layer 145 to push the porous layer 145 into the second configuration. The swellable metal sealing element 140 may continue to swell until the porous layer 145 contacts the wellbore wall 75*a*.

In some embodiments, the porous layer 145 is composed of a metal, plastic, composite, or other material woven or knitted mesh. In some embodiments, the porous layer 145 is a permeable elastomeric layer. However, the porous layer 145 can be any material or structure which allows gas and liquid passage, but restricts solids (e.g., particles produced from the sealing element 140 as the element 140 swells) movement. The porous layer 145 keeps the particles constrained in one area (i.e., the annulus 155) by using a filter type material. After setting, the constrained particles turn into a cement type structure as described herein. After the setting is complete, the porous layer 145 can remain (i.e., is permanent) or degrades over time without impacting the integrity of the packer 110.

Figure 4:
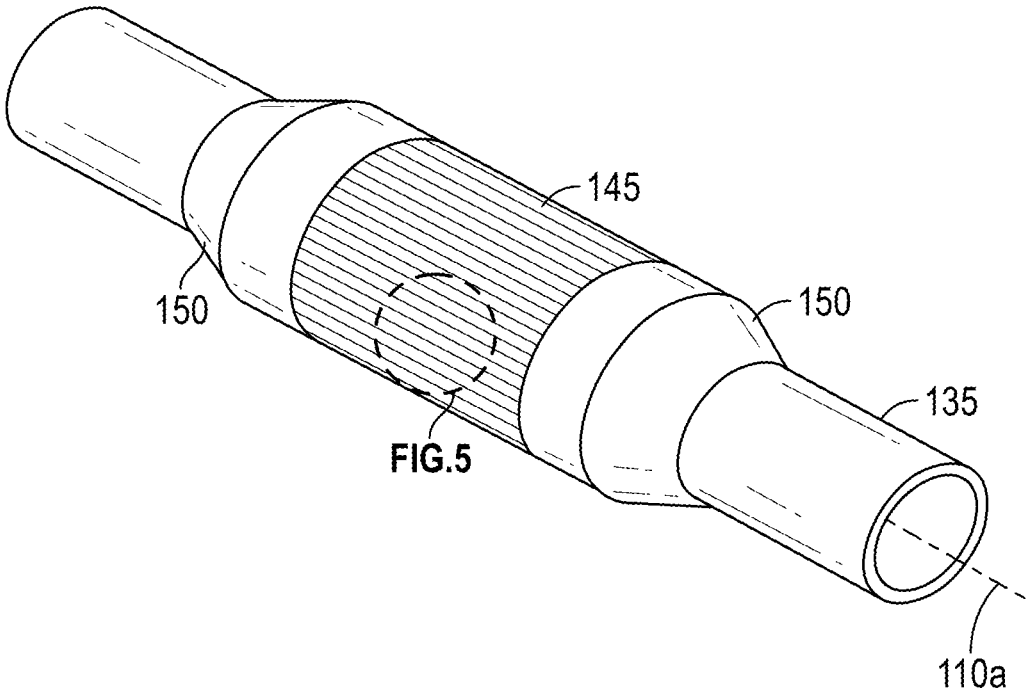
FIG. 4 is an isometric illustration the swell packer of FIG. 2, according to an example embodiment.
Figure 5:
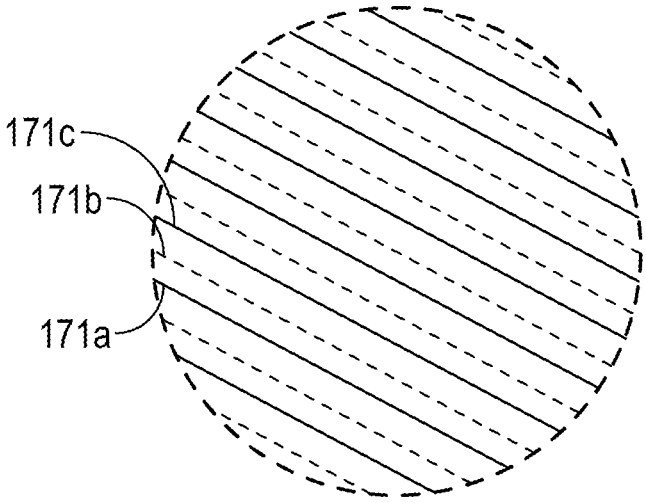
FIG. 5 is an enlarged top view of the external porous sleeve of the swell packer of FIG. 4, according to an example embodiment.

A perspective view of the packer 110, including the porous layer 145 when in the first configuration, is illustrated in FIG. 4. An enlarged top view of the porous layer 145 when in the first configuration and with the orientation of the porous layer 145 relative to the longitudinal axis 110*a* of the packer 110, is illustrated in FIG. 5. As illustrated, the porous layer 145 forms multiple longitudinal folds 171*a*, 171*b*, 171*c*, . . . 171*n* such that the porous layer 145 is pleated along the longitudinal axis 110*a*. That is, the diameter of the porous layer 145 is capable of expanding by unfolding some of the folds 171*a*, 171*b* . . . 171*n*.

Figure 6:
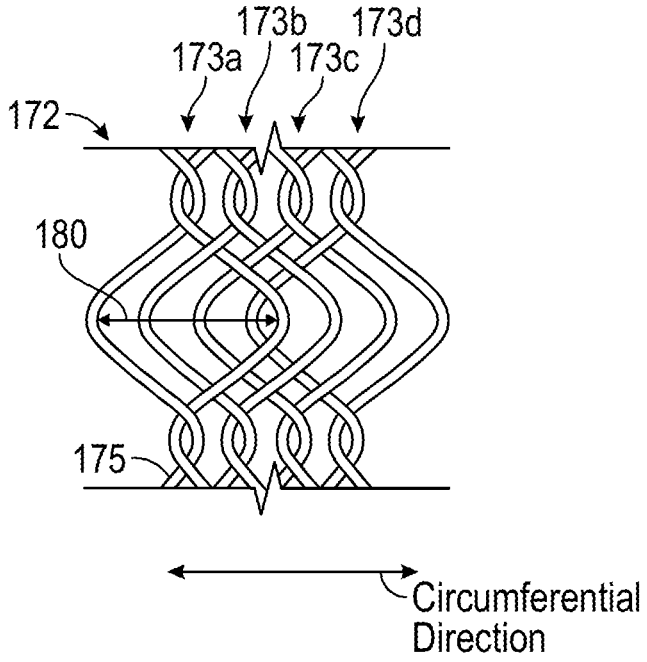
FIG. 6 is an enlarged top view of another embodiment of the external porous sleeve of FIG. 4 in the first configuration, according to another example embodiment.
Figure 7:
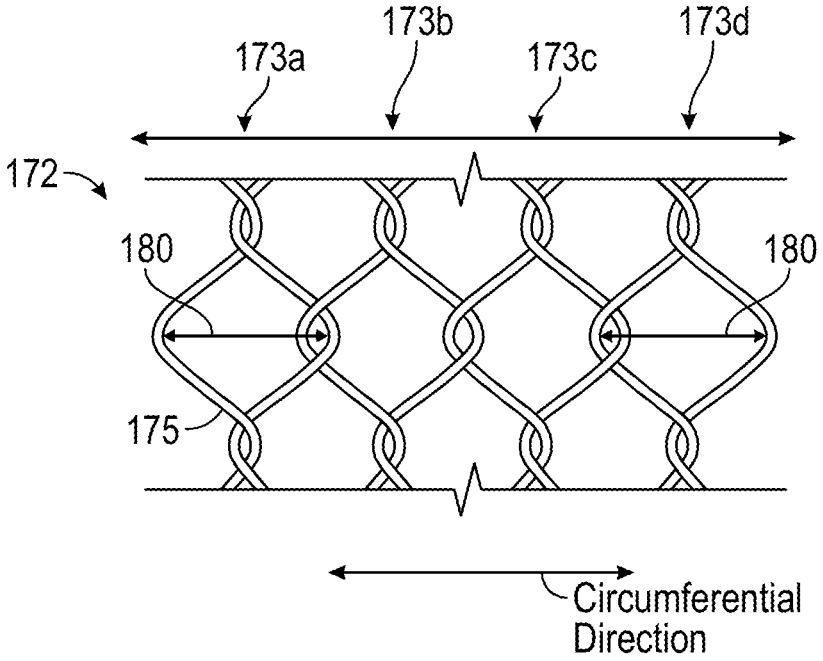
FIG. 7 is an enlarged top view of the external porous sleeve of FIG. 6 in the second configuration, according to another example embodiment.
Figure 8:
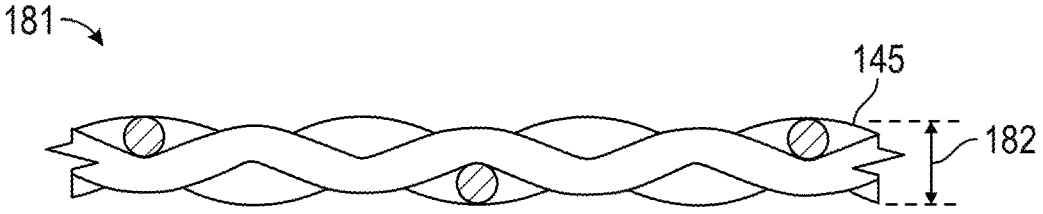
FIG. 8 is an enlarged cross-sectional view of another embodiment of the external porous sleeve of FIG. 4 in the second configuration.

Another embodiment of the porous layer 145 when in the first configuration is illustrated in FIG. 6. As illustrated in FIG. 6 the porous layer comprises a mesh 172 comprising nestable longitudinally-extending frame segments 173*a*, 173*b*, 173*c*, . . . 173*n* that together form a frame 175, with each nestable longitudinally-extending frame segment defining a pore size 180. The frame segments 173*a*, 173*b*, 173*c*, . . . 173*n* are nested together in the circumferential direction in the first configuration. The nestable longitudinally-extending frame segments 173*a*, 173*b*, 173*c*, . . . 173*n*, are movable circumferentially relative to the swellable metal sealing element 140 while maintaining the pore size 180 for each nestable longitudinally-extending frame segment 173*a*, 173*b*, 173*c*, . . . 173*n*, as illustrated in FIG. 7. In some embodiments, the pore size 180 is at least 125 microns. In some embodiments, the pore size 180 or void is sized based on a material of which the swellable metal sealing element 140 is at least partially composed. However, in other embodiments, the pore sizes 180 do not remain the same and portions of the frame 175 are stretched. For example, and as illustrated in FIG. 8 that includes a radial cross-sectional view of an embodiment 181 of a portion of the porous layer 145 in the second configuration, a woven pre-crimp mesh allows for the movement between the unexpanded and expanded diameters due to the straightening of wires and also about 30% mechanical stretching. In some embodiments, the thickness 182 of the layer 145 (measured in the radial direction from the axis 110) is about 1 millimeter.

Figure 9:
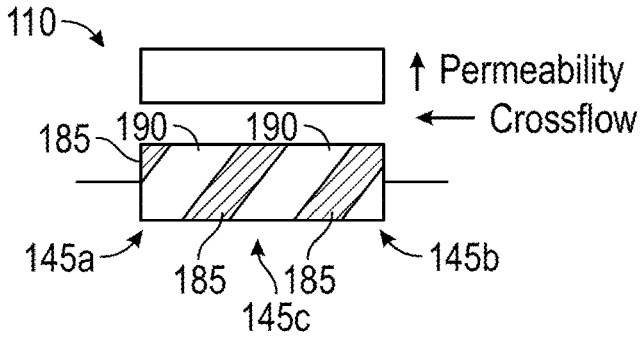
FIG. 9 is schematic side view illustration of another embodiment of the swell packer of FIG. 4 in the first configuration, according to yet another example embodiment.
Figure 10:
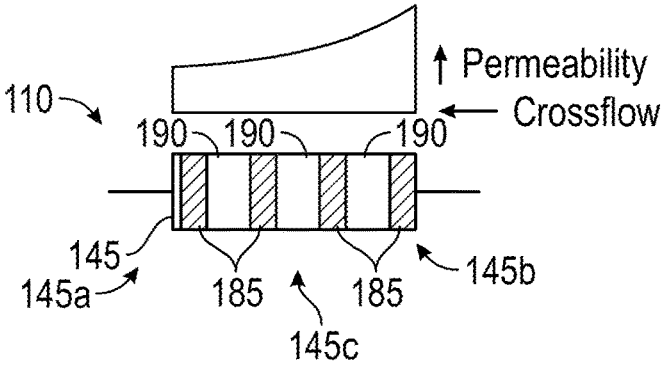
FIG. 10 is schematic side view illustration of another embodiment of the swell packer of FIG. 4 in the first configuration, according to yet another example embodiment.
Figure 11:
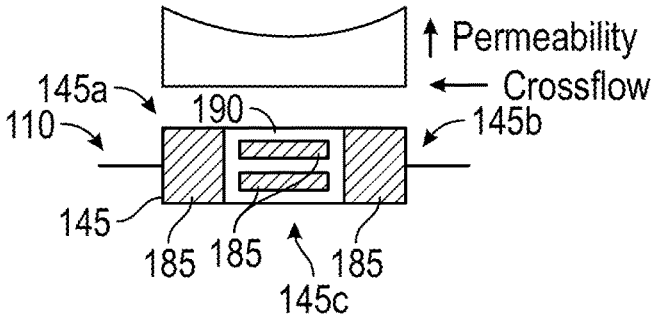
FIG. 11 is schematic side view illustration of another embodiment of the swell packer of FIG. 4 in the first configuration, according to yet another example embodiment.

In some embodiments and as illustrated in FIGS. 9-11, the porous layer 145 comprises first portions 185 having a first permeability and second portions 190 having a second permeability that is less than the first portions 185. In some embodiments, the first and second portions 185 and 190 are spaced longitudinally and/or circumferentially along the swellable metal sealing element 140. In some embodiments, the first portions 185 form a pattern relative to the second portions 190 and the pattern is variable along the circumferential and/or the longitudinal direction of the swellable metal sealing element 140. In some embodiments, the first portions 185 are shaped as circles, rectangles, etc. and extend circumferentially around the entirety or a partial portion of the swell packer 110, etc. In some embodiments and as illustrated in FIG. 9, the permeability is constant along the longitudinal axis of the swell packer 110. However, in other embodiments, the pore sizes 180 and the ratio of first and second portions 185 and 190 vary such that the porous layer 145 has a permeability that is variable along a circumferential and/or longitudinal direction of the well packer. For example, and as illustrated in FIG. 10, the permeability is higher at end 145*b* of the swell packer 110 versus the end 145*a*. While in FIG. 11, the permeability is higher on the ends 145*a* and 145*b* of the porous layer 145 relative to a middle portion 145*c* of the porous layer 145. In some embodiments, the porous layer 145 that is selected has a permeability that is based on a type of downhole fluid expected to contact the porous layer 145.

Figure 12:
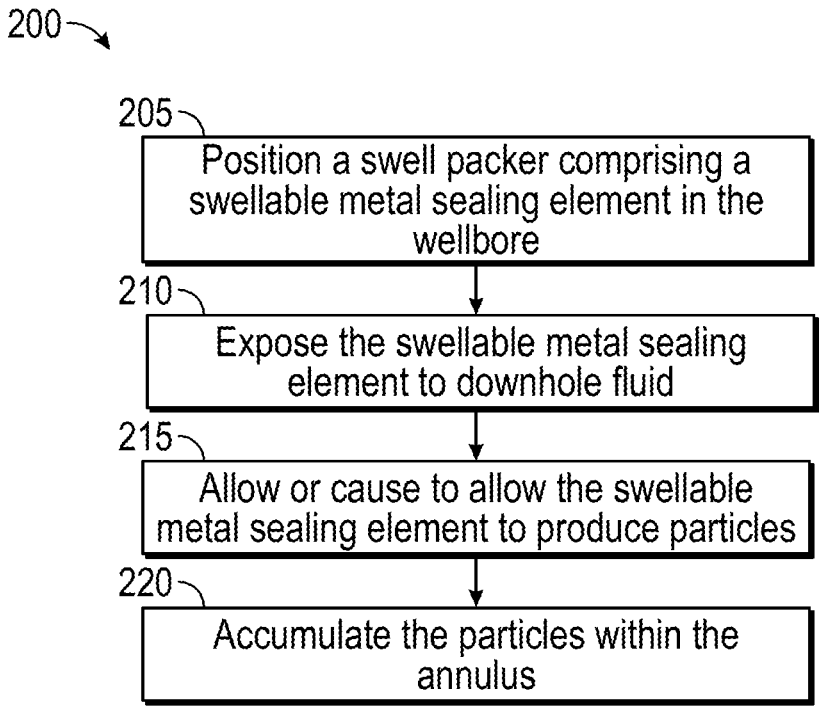
FIG. 12 is a flow chart illustration of a method of operating the apparatus of FIGS. 1-11, according to an example embodiment.

In an example embodiment, as illustrated in FIG. 12 with continuing reference to FIGS. 1-11, a method 200 of forming a seal in the wellbore 75 includes positioning the swell packer 110 comprising the swellable metal sealing element 140 in the wellbore 75 at step 205; exposing the swellable metal sealing element 140 to a downhole fluid at step 210; allowing or causing to allow the swellable metal sealing element 140 to produce particles at step 215; and accumulating the particles within the annulus 155 at step 220.

At the step 205, the swell packer 110 is positioned within the wellbore 75. Generally, the swell packer 110 is positioned within the wellbore 75 when swell packer 110, including the porous layer 145, is in the first configuration.

At the step 210, the swellable metal sealing element 140 is exposed to the downhole fluid via the porous layer 145. That is, the downhole fluids flow through the voids 180 of the frame 175 to contact the swellable metal sealing element 140. In some embodiments, the downhole fluids pass through the first portions 185 of the porous layer 145.

At the step 215, the swellable metal sealing element 140 is allowed or caused to allow to produce particles. In some embodiments, the swellable metal sealing element 140 is corroded, or permitted to corrode, to produce particles of the corroded metal or particles comprising a metal element, such as metal hydroxide particles or, equivalently, metal hydrate particles. Generally, the corrosion occurs due to exposure to a downhole fluid in the annulus 155. In one example embodiment, the swellable metal sealing element 140 is composed or formed from an alkaline earth metal (e.g., Mg, Ca, etc.) or a transition metal (e.g., Al, etc.). In one application, the material of the swellable metal sealing element 140 is a magnesium alloy including magnesium alloys that are alloyed with Al, Zn, Mn, Zr, Y, Nd, Gd, Ag, Ca, Sn, and RE. In some applications, the alloy is further alloyed with a dopant that promotes galvanic reaction, such as Ni, Fe, Cu, Co, Ir, Au, and Pd. In some embodiments, the magnesium alloy can be constructed in a solid solution process where the elements are combined with molten magnesium or magnesium alloy. Alternatively, the magnesium alloy could be constructed with a powder metallurgy process. Alternatively, the starting metal may be a metal oxide. For example, calcium oxide (CaO) with water will produce calcium hydroxide in an energetic reaction. Many metals will react with water to form a metal hydroxide and/or a metal oxide. Thus, water is one example of a corrosive fluid. This galvanic corrosion process results in the hydroxide material being released from the base metal. The products of the metal hydration reaction are particles or fines that have a diameter between 1 micron and 1000 microns. In some embodiments, additional ions, including silicate, sulfate, aluminate, phosphate, are added to the material from which the swellable metal sealing element 140 is composed. In some embodiments, the swellable metal sealing element 140 is alloyed to increase the reactivity or to control the formation of oxides. For example, and when the swellable metal sealing element 140 includes aluminum, then mercury, gallium, and other transition and post transition metals can be added in order to control the oxide formation. In some cases, the metal is heat treated to change the grain size of the particles such as through annealing, solution treating, aging, quenching, and hardening.

At the step 220, the particles are accumulated within the annulus 155. More specifically, the particles are accumulated within the annulus formed between the porous layer 145 and the base pipe 135. In some embodiments, enlarging the diameter of the porous layer 145 to sealingly engage the wall 175*a* of the wellbore 75 is a result of the accumulation of the particles within the annulus formed between the porous layer 145 and the base pipe 135. Thus, the swell packer 110 swells to sealingly engage the wall 75*a*. When enough fines accumulate, they lock together and form a cement-like seal. In some embodiments, as the metal hydroxide particles continues to be produced and are trapped by the porous layer 145, the particles get squeezed together. This squeezing together locks the hydroxide particles into a solid seal. In one embodiment, the metal hydroxide or metal particles are dehydrated by the swellable pressure to form a metal oxide. In some embodiments, the material from which the swellable metal sealing element 140 is formed is determined or selected based on the expected downhole fluid. In some embodiments, the swell packer 110 swells to form a plug formed from the accumulating and locking of the particles together in the annulus 155. In one variation, the swellable metal sealing element 140, or sluffable metal seal, is formed in a serpentine reaction. In another variation, at least a portion of the swellable metal sealing element 140 is a mafic material. In some embodiments, the swellable metals swell by undergoing metal hydration reactions in the presence of brines to form metal hydroxides. The metal hydroxide occupies more space than the base metal reactant. This expansion in volume allows the swellable metal to form a seal at the interface of the swellable metal and any adjacent surfaces. For example, a mole of magnesium has a molar mass of 24 g/mol and a density of 1.74 g/cm3 which results in a volume of 13.8 cm3/mol. Magnesium hydroxide has a molar mass of 60 g/mol and a density of 2.34 g/cm3 which results in a volume of 25.6 cm3/mol. 25.6 cm3/mol is 85% more volume than 13.8 cm3/mol. As another example, a mole of calcium has a molar mass of 40 g/mol and a density of 1.54 g/cm3 which results in a volume of 26.0 cm3/mol. Calcium hydroxide has a molar mass of 76 g/mol and a density of 2.21 g/cm3 which results in a volume of 34.4 cm3/mol. 34.4 cm3/mol is 32% more volume than 26.0 cm3/mol. As yet another example, a mole of aluminum has a molar mass of 27 g/mol and a density of 2.7 g/cm3 which results in a volume of 10.0 cm3/mol. Aluminum hydroxide has a molar mass of 63 g/mol and a density of 2.42 g/cm3 which results in a volume of 26 cm3/mol. 26 cm3/mol is 160% more volume than 10 cm3/mol. The swellable metal comprises any metal or metal alloy that may undergo a hydration reaction to form a metal hydroxide of greater volume than the base metal or metal alloy reactant. The metal may become separate particles during the hydration reaction and these separate particles lock or bond together to form what is considered as a swellable metal. Examples of suitable metals for the swellable metal include, but are not limited to, magnesium, calcium, aluminum, tin, zinc, beryllium, barium, manganese, or any combination thereof. Preferred metals include magnesium, calcium, and aluminum.

Examples of suitable metal alloys for the swellable metal include, but are not limited to, any alloys of magnesium, calcium, aluminum, tin, zinc, beryllium, barium, manganese, or any combination thereof. Preferred metal alloys include alloys of magnesium-zinc, magnesium-aluminum, calcium-magnesium, or aluminum-copper. In some examples, the metal alloys may comprise alloyed elements that are not metallic. Examples of these non-metallic elements include, but are not limited to, graphite, carbon, silicon, boron nitride, and the like. In some examples, the metal is alloyed to increase reactivity and/or to control the formation of oxides.

In examples where the swellable metal comprises a metal alloy, the metal alloy may be produced from a solid solution process or a powder metallurgical process. The sealing element comprising the metal alloy may be formed either from the metal alloy production process or through subsequent processing of the metal alloy.

As used herein, the term "solid solution" refers to an alloy that is formed from a single melt where all of the components in the alloy (e.g., a magnesium alloy) are melted together in a casting. The casting can be subsequently extruded, wrought, hipped, or worked to form the desired shape for the sealing element of the swellable metal. Preferably, the alloying components are uniformly distributed throughout the metal alloy, although intra-granular inclusions may be present, without departing from the scope of the present disclosure. It is to be understood that some minor variations in the distribution of the alloying particles can occur, but it is preferred that the distribution is such that a homogeneous solid solution of the metal alloy is produced. A solid solution is a solid-state solution of one or more solutes in a solvent. Such a mixture is considered a solution rather than a compound when the crystal structure of the solvent remains unchanged by addition of the solutes, and when the mixture remains in a single homogeneous phase.

A powder metallurgy process generally comprises obtaining or producing a fusible alloy matrix in a powdered form. The powdered fusible alloy matrix is then placed in a mold or blended with at least one other type of particle and then placed into a mold. Pressure is applied to the mold to compact the powder particles together, fusing them to form a solid material which may be used as the swellable metal.

In some alternative examples, the swellable metal comprises an oxide. As an example, calcium oxide reacts with water in an energetic reaction to produce calcium hydroxide. 1 mole of calcium oxide occupies 9.5 cm3 whereas 1 mole of calcium hydroxide occupies 34.4 cm3 which is a 260% volumetric expansion. Examples of metal oxides include oxides of any metals disclosed herein, including, but not limited to, magnesium, calcium, aluminum, iron, nickel, copper, chromium, tin, zinc, lead, beryllium, barium, gallium, indium, bismuth, titanium, manganese, cobalt, or any combination thereof.

It is to be understood, that the selected swellable metal is to be selected such that the formed sealing element does not degrade into the brine. As such, the use of metals or metal alloys for the swellable metal that form relatively water-insoluble hydration products may be preferred. For example, magnesium hydroxide and calcium hydroxide have low solubility in water. Alternatively, or in addition to, the sealing element may be positioned in the downhole tool such that degradation into the brine is constrained due to the geometry of the area in which the sealing element is disposed and thus resulting in reduced exposure of the sealing element. For example, the volume of the area in which the sealing element is disposed is less than the expansion volume of the swellable metal. In some examples, the volume of the area is less than as much as 50% of the expansion volume. Alternatively, the volume of the area in which the sealing element may be disposed may be less than 90% of the expansion volume, less than 80% of the expansion volume, less than 70% of the expansion volume, or less than 60% of the expansion volume.

In some examples, the metal hydroxide formed from the swellable metal may be dehydrated under sufficient swelling pressure. For example, if the metal hydroxide resists movement from additional hydroxide formation, elevated pressure may be created which may dehydrate the metal hydroxide. This dehydration may result in the formation of the metal oxide from the swellable metal. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water. The dehydration of the hydroxide forms of the swellable metal may allow the swellable metal to form additional metal hydroxide and continue to swell.

Figure 13:
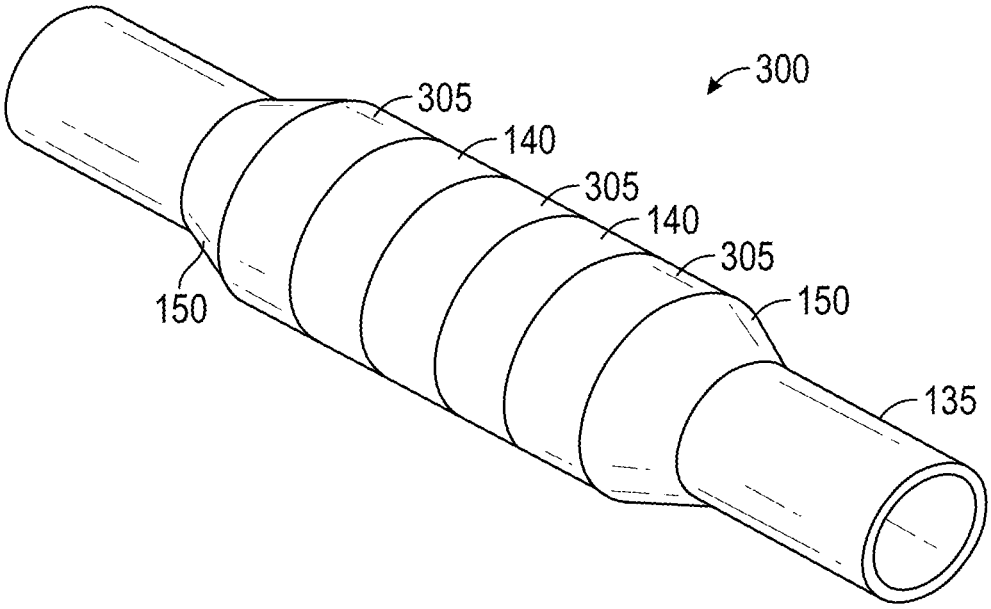
FIG. 13 is an isometric illustration of yet another embodiment of the swell packer of FIG. 4 without the external porous sleeve, according to an example embodiment.

The porous layer 145 is capable of being disposed about a variety of swell packers. For example, FIG. 13 is an isometric illustration of another example of a swell packer, generally 300, disposed on the base pipe 135 with the porous layer 145 removed. The swell packer 300 comprises multiple swellable metal sealing elements 140 and also multiple swellable non-metal sealing elements 305. The swell packer 300 is wrapped or slipped on the base pipe 135 with weight, grade, and connection specified by the well design. The swell packer 300 further comprises optional end rings 150 as described in FIG. 2. Swell packer 300 differs from swell packer 110 in that swell packer 300 alternates swellable metal sealing elements 140 and swellable non-metal sealing elements 305. The swell packer 300 may comprise any multiple of swellable metal sealing elements 140 and swellable non-metal sealing elements 305 arranged in any pattern (e.g., alternating, as illustrated). The multiple swellable metal sealing elements 140 and swellable non-metal sealing elements 305 may swell as desired to create an annular seal as described above. In some examples, the swellable metal sealing elements 305 may comprise different types of swellable metals, allowing the swell packer 300 to be custom configured to the well as desired.

In some embodiments, the swellable non-metal sealing elements 305 may comprise any oil-swellable, water-swellable, and/or combination swellable non-metal material as would occur to one of ordinary skill in the art. A specific example of a swellable non-metal material is a swellable elastomer. The swellable non-metal sealing elements 305 may swell when exposed to a fluid that induces swelling (e.g., an oleaginous or aqueous fluid). Generally, the swellable non-metal sealing elements 305 may swell through diffusion whereby the swelling-inducing fluid is absorbed into the swellable non-metal sealing elements 305. This fluid may continue to diffuse into the swellable non-metal sealing elements 305 causing the swellable non-metal sealing elements 305 to swell until they contact the adjacent wellbore wall, working in tandem with the swellable metal sealing element 140 to create a differential annular seal.

Figure 14:
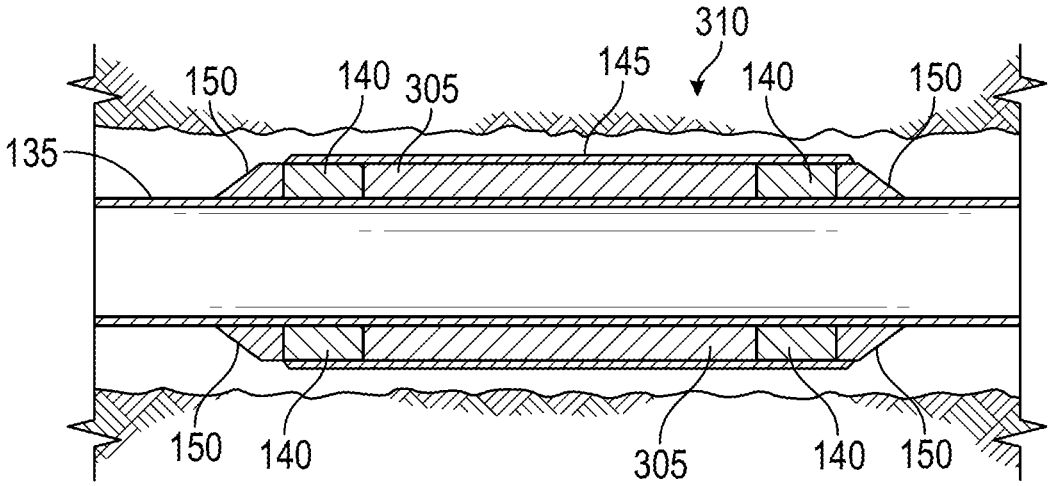
FIG. 14 is a cross-sectional illustration of another embodiment of the swell packer of FIG. 4, according to yet another example embodiment.

FIG. 14 is a cross-section illustration of another example of a swell packer, generally 310, disposed on the base pipe 135. As described above in the example of FIG. 13, the swell packer 300 comprises an alternative arrangement of multiple swellable metal sealing elements 140 and a swellable non-metal sealing element 305. In this example, swell packer 310 comprises two swellable metal sealing elements 140 individually disposed adjacent to both an end ring 150 and one end of the swellable non-metal sealing element 305. As illustrated, optional end rings 150 may protect the swell packer 310 from abrasion as it is run in hole.

Figure 15:
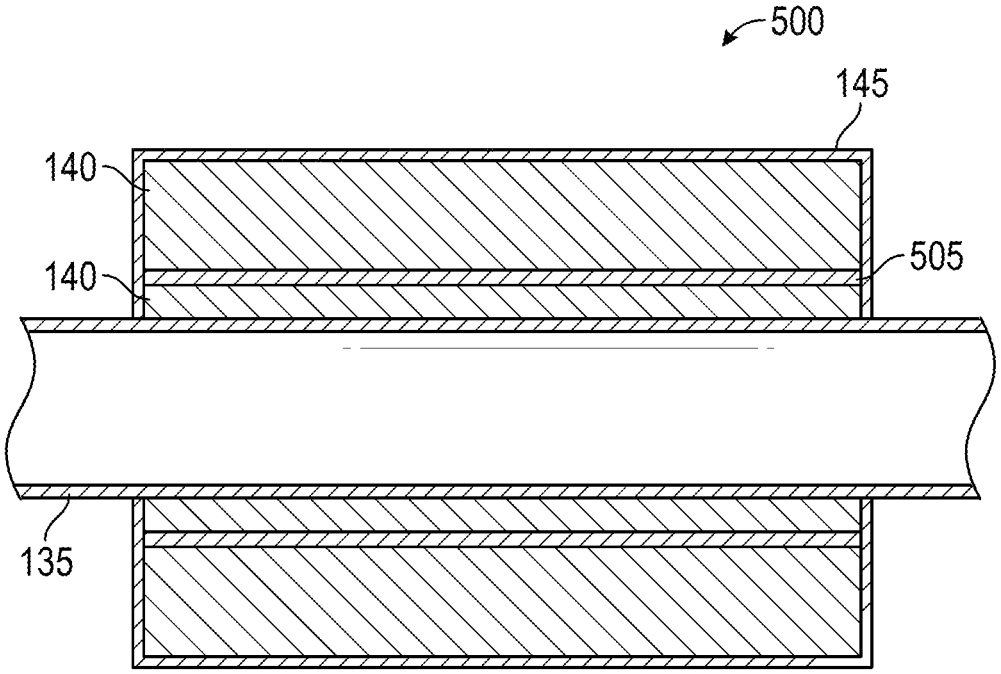
FIG. 15 is a cross-sectional illustration of another embodiment of the swell packer of FIG. 4, according to yet another example embodiment.

FIG. 15 is a cross-section illustration of another example of a swell packer, generally 500, disposed on a base pipe 135. The swell packer 500 comprises swellable metal sealing elements 140 and a reinforcement layer 505. Reinforcement layer 505 may be disposed between two layers of swellable metal sealing elements 140 as illustrated. Reinforcement layer 505 may provide extrusion resistance to the swellable metal sealing elements 140, and may also provide additional strength to the structure of the swell packer 500 and increase the pressure holding capabilities of swell packer 500. Reinforcement layer 505 may comprise any sufficient material for reinforcement of the swell packer 500. An example of a reinforcement material is steel. Generally, reinforcement layer 505 will comprise a non-swellable material. Further, reinforcement layer 505 may be perforated or solid. Swell packer 500 is not illustrated with optional end rings. However, in some examples, swell packer 500 may comprise the optional end rings. In an alternative example, the swell packer 500 may comprise a layer of swellable metal sealing element 140 and a layer of swellable non-metal sealing element (e.g., swellable non-metal sealing elements) 305. In one specific example, the outer layer may be the swellable metal sealing element 140 and the inner layer may be the swellable non-metal sealing element 305. In another specific example, the outer layer may be the swellable non-metal sealing element 305 and the inner layer may be the swellable metal sealing element 140.

Figure 16:
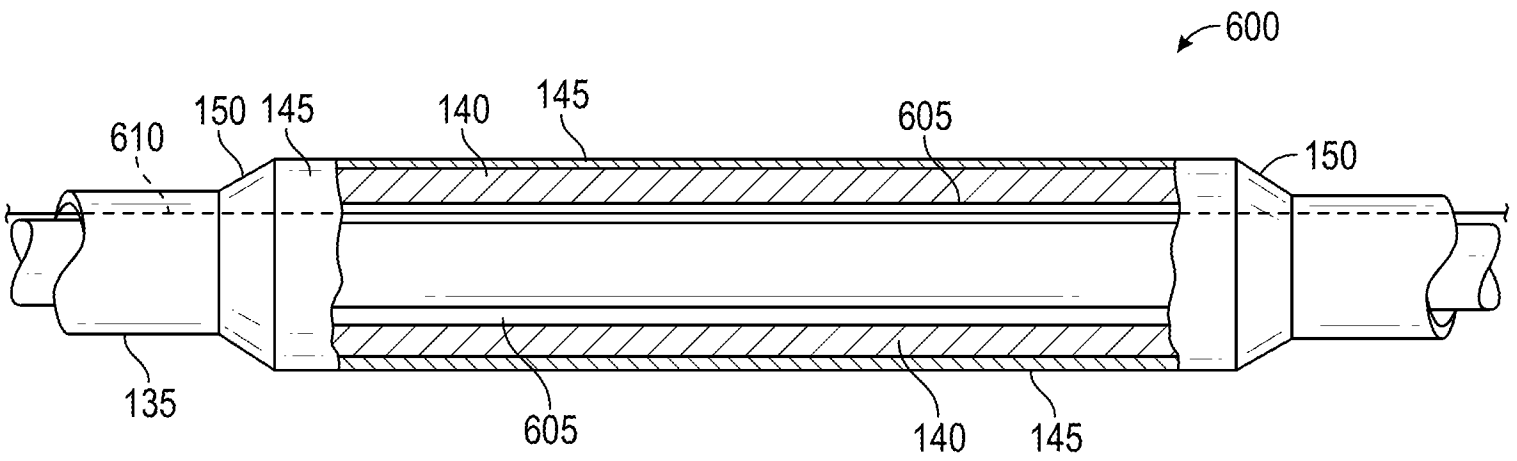
FIG. 16 is a cross-sectional illustration of yet another embodiment of the swell packer of FIG. 4, according to yet another example embodiment.

FIG. 16 is an isometric illustration of another example of a swell packer, generally 600, disposed on a base pipe 135. The swell packer 600 comprises at least two swellable metal sealing elements 140. In the example of swell packer 600, multiple swellable metal sealing elements 140 are illustrated. The swellable metal sealing elements 140 are arranged as strips or slats with gaps 605 disposed between the individual swellable metal sealing elements 140. Within the gaps 605, a line 610 may be run. Line 610 may be run from the surface and down the exterior of the base pipe 135. Line 610 may be a control line, power line, hydraulic line, or more generally, a conveyance line that may convey power, data, instructions, pressure, fluids, etc. from the surface to a location within a wellbore. Line 610 may be used to power a downhole tool, control a downhole tool, provide instructions to a downhole tool, obtain wellbore environmental measurements, inject a fluid, etc. When swelling is induced in swellable metal sealing elements 305, the swellable metal sealing elements 140 may swell and close gaps 605 allowing an annular seal to be produced. The swellable metal sealing elements 140 may swell around any line 610 that may be present, and as such, line 610 may still function and successfully span the swell packer 600 even after setting.

Figure 17:
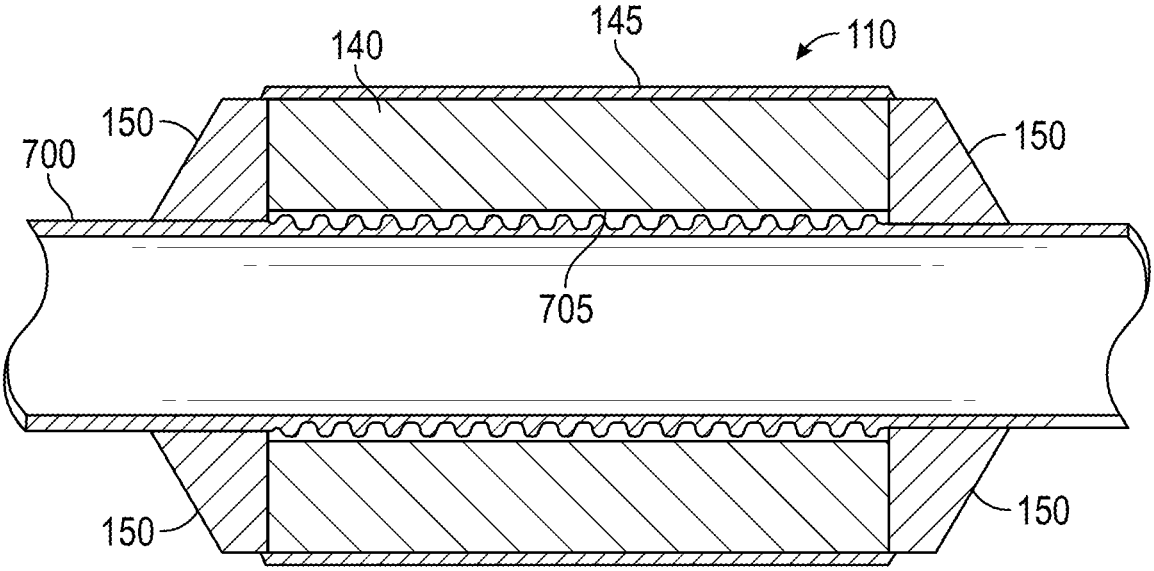
FIG. 17 is a cross-sectional illustration of yet another embodiment of the swell packer of FIG. 4, according to yet another example embodiment.

FIG. 17 is a cross-section illustration of another embodiment of the swell packer 110 as described in FIG. 2 around a conduit 700. The swell packer 110 is wrapped or slipped on the conduit 700 with weight, grade, and connection specified by the well design. Conduit 700 comprises a profile variance, specifically, ridges 705 on a portion of its exterior surface. Swell packer 110 is disposed over the ridges 705. As the swellable metal sealing element 140 swells, it may swell into the in-between spaces of the ridges 705 allowing the swellable metal sealing element 140 to be even further compressed when a differential pressure is applied. In addition to, or as a substitute for ridges 705, the profile variance on the exterior surface of the conduit 700 may comprise threads, tapering, slotted gaps, or any such variance allowing for the swellable metal sealing element 140 to swell within an interior space on the exterior surface of the conduit 700. Although FIG. 17 illustrates the use of swell packer 110, it is to be understood that any swell packer or combination of swell packers may be used in any of the examples disclosed herein.

Figure 18:
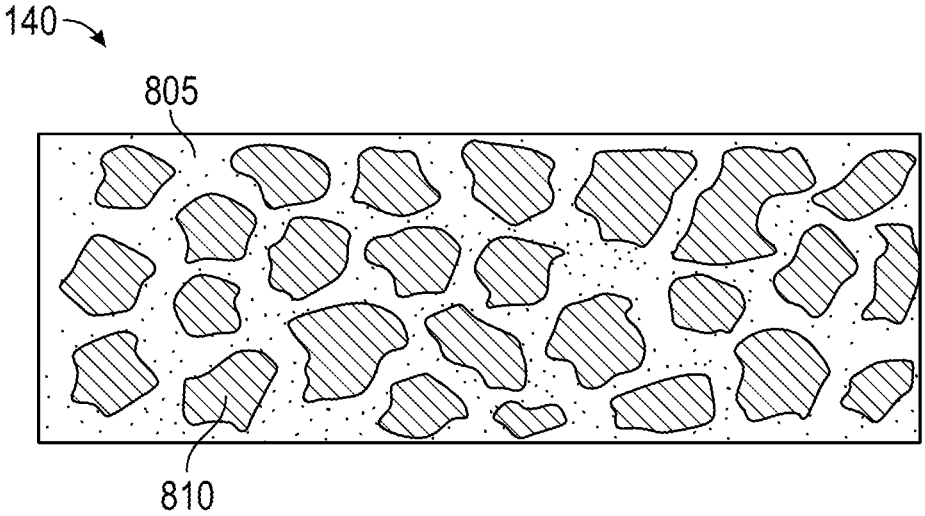
FIG. 18 is a cross-sectional illustration of a portion of a sealing element comprising a binder having a swellable metal dispersed.

FIG. 18 is a cross-sectional illustration of a portion of a swellable metal sealing element 140 and used as described above. This specific swellable metal sealing element 140 comprises a binder 805 and has the swellable metal 810 dispersed therein. As illustrated, the swellable metal 810 may be distributed within the binder 805. The distribution may be homogeneous or non-homogeneous. The swellable metal 810 may be distributed within the binder 805 using any suitable method. Binder 805 may be any binder material as described herein. Binder 805 may be non-swelling, oil-swellable, water-swellable, or oil- and water-swellable. Binder 805 may be degradable. Binder 805 may be porous or non-porous. The swellable metal sealing element 140 comprising binder 805 and having a swellable metal 810 dispersed therein may be used in any of the examples described herein. In one embodiment, the swellable metal 810 may be mechanically compressed, and the binder 805 may be cast around the compressed swellable metal 810 in a desired shape. In some examples, additional non-swelling reinforcing agents may also be placed in the binder such as fibers, particles, or weaves. General examples of the binder 805 include, but are not limited to, rubbers, plastics, and elastomers. Specific examples of the binder 805 may include, but are not limited to, polyvinyl alcohol, polylactic acid, polyurethane, polyglycolic acid, nitrile rubber, isoprene rubber, PTFE, silicone, fluroelastomers, ethylene-based rubber, and PEEK. In some embodiments, the dispersed swellable metal may be cuttings obtained from a machining process.

In some embodiments, the swell packer 110 may also be used to form an annular seal between two conduits that are not the casing or wall 75*a*. It is also to be recognized that the disclosed sealing elements may also directly or indirectly affect the various downhole equipment and tools that may come into contact with the sealing elements during operation. Such equipment and tools may include, but are not limited to, wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described herein.

In some embodiments, the swell packer 110 may be used to form a seal at the interface of the sealing element and an adjacent surface having profile variances, a rough finish, etc. These surfaces are not smooth, even, and/or consistent at the area where the sealing is to occur. These surfaces may have any type of indentation or projection, for example, gashes, gaps, pocks, pits, holes, divots, and the like. Additive manufactured components may not involve precision machining and may, in some examples, comprise a rough surface finish. In some examples, the components may not be machined and may just comprise the cast finish. The sealing elements may expand to fill and seal the imperfect areas of these adjacent areas allowing a seal to be formed between surfaces that may be difficult to seal otherwise. Advantageously, the sealing elements may also be used to form a seal at the interface of the sealing element and an irregular surface component. For example, components manufactured in segments or split with scarf joints, butt joints, splice joints, etc. may be sealed, and the hydration process of the swellable metals may be used to close the gaps in the irregular surface. As such, the swellable metal sealing elements may be viable sealing options for difficult to seal surfaces.

In some embodiments, the swell packer 110 may be used to form a seal between any adjacent surfaces in the wellbore between and/or on which the swell packer 110 may be disposed. Without limitation, the swell packer 110 may be used to form seals on conduits, formation surfaces, cement sheaths, downhole tools, and the like. For example, the swell packer 110 may be used to form a seal between the outer diameter of a conduit and a cement sheath (e.g., a casing). As another example, the swell packer 110 may be used to form a seal between the outer diameter of one conduit and the inner diameter of another conduit (which may be the same or different). Moreover, a plurality of swell packers may be used to form seals between multiple strings of conduits (e.g., oilfield tubulars). In one specific example, the swell packer 110 may form a seal on the inner diameter of a conduit to restrict fluid flow through the inner diameter of a conduit, thus functioning similarly to a bridge plug. It is to be understood that the swell packer 110 may be used to form a seal between any adjacent surfaces in the wellbore and the disclosure is not to be limited to the explicit examples disclosed herein.

As described above, the swellable metal sealing element 140 is produced from swellable metals and as such, are non-elastomeric materials except for the specific examples that further comprise an elastomeric binder for the swellable metals. As non-elastomeric materials, the swellable metal sealing elements do not possess elasticity, and therefore, they irreversibly swell when contacted with a brine. The swellable metal sealing element 140 does not return to their original size or shape even after the brine is removed from contact. In examples comprising an elastomeric binder, the elastomeric binder may return to its original size or shape; however, any swellable metal dispersed therein would not.

In some embodiments, the brine may be saltwater (e.g., water containing one or more salts dissolved therein), saturated saltwater (e.g., saltwater produced from a subterranean formation), seawater, fresh water, or any combination thereof. Generally, the brine may be from any source. The brine may be a monovalent brine or a divalent brine. Suitable monovalent brines may include, for example, sodium chloride brines, sodium bromide brines, potassium chloride brines, potassium bromide brines, and the like. Suitable divalent brines can include, for example, magnesium chloride brines, calcium chloride brines, calcium bromide brines, and the like. In some examples, the salinity of the brine may exceed 10%. In said examples, use of elastomeric sealing elements may be impacted. Advantageously, the swellable metal sealing element 140 of the present disclosure is not impacted by contact with high-salinity brines. One of ordinary skill in the art, with the benefit of this disclosure, should be readily able to select a brine for a chosen application.

The swell packer 110 may be used in high-temperature formations, for example, in formations with zones having temperatures equal to or exceeding 350° F. In these high-temperature formations, use of elastomeric sealing elements may be impacted.

In some embodiments, the layer 145 extends about the entirety of the circumference and/or length of the swellable element 140, while in other embodiments the layer 145 extends about a portion of the circumference and/or length of the swellable element 140.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present disclosure. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

Thus, a well packer has been described. Embodiments of the well packer may generally include a tubular; a swellable metal sealing element disposed about the tubular; and a porous layer disposed about the swellable metal sealing element. Any of the foregoing embodiments may include any one of the following elements, alone or in combination with each other:

The porous layer is movable between a first configuration in which the porous layer defines an unexpanded diameter and a second configuration in which the porous layer defines an expanded diameter that is greater than the unexpanded diameter.

When in the first configuration, the porous layer forms multiple longitudinal folds such that the porous layer is pleated.

The porous layer comprises a mesh comprising nestable longitudinally-extending frame segments.

Each nestable longitudinally-extending frame segment defines a pore size.

The nestable longitudinally-extending frame segments are movable circumferentially relative to the swellable metal sealing element while maintaining the pore size for each nestable longitudinally-extending frame segment.

The porous layer comprises a frame defining a plurality of voids, and wherein each void is sized based on a material of which the swellable metal sealing element is at least partially composed.

The porous layer comprises first portions having a first permeability and second portions having a second permeability that is less than the first portion.

The first and second portions are spaced longitudinally and/or circumferentially along the swellable metal sealing element.

The first portions form a pattern relative to the second portions; and wherein the pattern is variable along a circumferential and/or longitudinal direction of the swellable metal sealing element.

The swellable metal sealing element comprises magnesium and/or aluminum.

The porous layer that is selected has a permeability that is based on the downhole fluid expected to contact the porous layer.

The porous layer has a permeability that is variable along a circumferential and/or longitudinal direction of the well packer.

Thus, a method for forming a seal in a wellbore has been described. Embodiments of the method may generally include positioning a swell packer comprising a swellable metal sealing element in the wellbore; wherein a porous layer is disposed about the swellable metal sealing element; exposing the swellable metal sealing element to a downhole fluid; allowing or causing to allow the swellable metal sealing element to produce particles; and accumulating the particles within a first annulus formed between the porous layer and the swellable metal sealing element. Any of the foregoing embodiments may include any one of the following elements, alone or in combination with each other:

Enlarging the diameter of the porous layer to sealingly engage a wall of the wellbore.

The accumulation of the particles results in the enlargement of the diameter of the porous layer.

The porous layer forms multiple longitudinal folds such that the porous layer is pleated.

The swell packer comprises magnesium and/or aluminum.

The porous layer comprises a mesh comprising nestable longitudinally-extending frame segments.

Each nestable longitudinally-extending frame segment defines a pore size.

Enlarging the diameter of the porous layer comprises circumferentially moving the nestable longitudinally-extending frame segments while maintaining the pore size for each nestable longitudinally-extending frame segment.

The porous layer comprises a frame defining pores.

The pores are sized based on a material forming the swellable metal sealing element.

The swellable metal sealing element comprises magnesium.

Selecting the porous layer having a permeability based on the downhole fluid expected to contact the porous layer.

The porous layer has a permeability that is variable along a circumferential and/or longitudinal direction of the swell packer.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

In several example embodiments, while different steps, processes, and procedures are described as appearing as distinct acts, one or more of the steps, one or more of the processes, and/or one or more of the procedures could also be performed in different orders, simultaneously and/or sequentially. In several example embodiments, the steps, processes and/or procedures could be merged into one or more steps, processes and/or procedures.

It is understood that variations may be made in the foregoing without departing from the scope of the disclosure. Furthermore, the elements and teachings of the various illustrative example embodiments may be combined in whole or in part in some or all of the illustrative example embodiments. In addition, one or more of the elements and teachings of the various illustrative example embodiments may be omitted, at least in part, and/or combined, at least in part, with one or more of the other elements and teachings of the various illustrative embodiments.

In several example embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several example embodiments have been described in detail above, the embodiments described are example only and are not limiting, and those skilled in the art will readily appreciate that many other modifications, changes and/or substitutions are possible in the example embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

Illustrative embodiments and related methods of the present disclosure are described below as they might be employed in a pressure actuated inflow control device. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

What is claimed is:

1. A swell packer, comprising:

a tubular;

a swellable metal sealing element disposed about the tubular; and a porous layer disposed about the swellable metal sealing element;

wherein the swellable metal sealing element is configured to react with a downhole fluid to produce particles; and wherein the porous layer is configured to contain the particles in an annulus between the porous layer and the tubular.

2. The swell packer of claim 1, wherein the porous layer is movable between a first configuration in which the porous layer defines an unexpanded diameter and a second configuration in which the porous layer defines an expanded diameter that is greater than the unexpanded diameter.

3. The swell packer of claim 2, wherein, when in the first configuration, the porous layer forms multiple longitudinal folds such that the porous layer is pleated.

4. The swell packer of claim 1, wherein the porous layer comprises a mesh comprising nestable longitudinally-extending frame segments;

wherein each nestable longitudinally-extending frame segment defines a pore size; and wherein the nestable longitudinally-extending frame segments are movable circumferentially relative to the swellable metal sealing element while maintaining the pore size for each nestable longitudinally-extending frame segment.

5. The swell packer of claim 1, wherein the porous layer comprises a frame defining a plurality of voids, and wherein each void is sized based on a material of which the swellable metal sealing element is at least partially composed.

6. The swell packer of claim 1, wherein the porous layer comprises first portions having a first permeability and second portions having a second permeability that is less than the first portions; and wherein the first and second portions are spaced longitudinally and/or circumferentially along the swellable metal sealing element.

7. The swell packer of claim 6, wherein the first portions form a pattern relative to the second portions; and wherein the pattern is variable along a longitudinal direction of the swellable metal sealing element.

8. The swell packer of claim 6, wherein the porous layer that is selected has a permeability that is based on the downhole fluid expected to contact the porous layer.

9. The swell packer of claim 1, wherein the swellable metal sealing element comprises magnesium and/or aluminum.

10. The swell packer of claim 1, wherein the porous layer has a permeability that is variable along a longitudinal direction of the well packer.

11. A method for forming a seal in a wellbore comprising:

positioning a swell packer comprising a swellable metal sealing element disposed about a tubular in the wellbore;

wherein a porous layer is disposed about the swellable metal sealing element;

exposing the swellable metal sealing element to a downhole fluid;

allowing or causing to allow the swellable metal sealing element to react with the downhole fluid to produce particles; and accumulating the particles within a first annulus formed between the porous layer and the tubular.

12. The method of claim 11, further comprising enlarging a diameter of the porous layer to sealingly engage a wall of the wellbore.

13. The method of claim 12, wherein the accumulation of the particles results in the enlargement of the diameter of the porous layer.

14. The method of claim 12, wherein the porous layer forms multiple longitudinal folds such that the porous layer is pleated.

15. The method of claim 11, wherein the swell packer comprises magnesium and/or aluminum.

16. The method of claim 11, wherein the porous layer comprises a mesh comprising nestable longitudinally-extending frame segments;

wherein each nestable longitudinally-extending frame segment defines a pore size; and wherein enlarging the diameter of the porous layer comprises circumferentially moving the nestable longitudinally-extending frame segments while maintaining the pore size for each nestable longitudinally-extending frame segment.

17. The method of claim 11, wherein the porous layer comprises a frame defining pores, and wherein the pores are sized based on a material forming the swellable metal sealing element.

18. The method of claim 11, wherein the swellable metal sealing element comprises magnesium.

19. The method of claim 11, further comprising selecting the porous layer having a permeability based on the downhole fluid expected to contact the porous layer.

20. The method of claim 11, wherein the porous layer has a permeability that is variable along a longitudinal direction of the swell packer.

* * * * *